US006003856A

United States Patent [19]

Holland-Letz et al.

[11] Patent Number: 6,003,856

[45] Date of Patent: Dec. 21, 1999

[54] SYSTEM FOR DISPENSING SHEET MATERIAL, IN PARTICULAR SECURITY DOCUMENTS

[75] Inventors: Günter Holland-Letz, Paderborn; Ulrich Nottelmann, Bad Driburg; Udo Tewes, Paderborn; Peter Weigel, Borchen, all of Germany

[73] Assignee: Siemens Nixdorf Informationssysteme Aktiengesellschaft, Paderborn, Germany

[21] Appl. No.: 09/043,955

[22] PCT Filed: Aug. 21, 1996

[86] PCT No.: PCT/DE96/01548

§ 371 Date: Mar. 27, 1998

§ 102(e) Date: Mar. 27, 1998

[87] PCT Pub. No.: WO97/12824

PCT Pub. Date: Apr. 10, 1997

[30] Foreign Application Priority Data

Sep. 29, 1995 [DE] Germany ..... 195 36 480

[51] Int. Cl.[6] ..... B65H 3/44; B65H 5/26

[52] U.S. Cl. ..... 271/9.02; 271/9.12

[58] Field of Search ..... 271/9.01, 9.02, 271/9.04, 9.12, 9.13, 34

[56] References Cited

U.S. PATENT DOCUMENTS

| | | | |
|---|---|---|---|
| 4,518,158 | 5/1985 | Goi . | |
| 4,577,849 | 3/1986 | Watanabe | 271/9.02 |
| 4,691,910 | 9/1987 | Cargill et al. | 271/9.12 |

FOREIGN PATENT DOCUMENTS

| | | | |
|---|---|---|---|
| 0 161 742 | 11/1985 | European Pat. Off. . | |
| 0 338 256 | 10/1989 | European Pat. Off. . | |
| 632100335A | 5/1987 | Japan | 271/9.12 |

OTHER PUBLICATIONS

Patent Abstracts of Japan 07137870 May 3, 1995, "Bank Note Delivery System", published May 1995.

*Primary Examiner*—H. Grant Skaggs
*Attorney, Agent, or Firm*—Hill & Simpson

[57] ABSTRACT

A system for dispensing sheet material such as security documents from one of two sheet compartments to a collecting station is disclosed. The system includes a delivery roller and a stepping motor provided independently for each of the two sheet compartments. The delivery roller associated with each of the sheet compartments draws the foremost sheet from a sheet stack within the respective compartment. The foremost sheet drawn off from the stack is fed to a conveyor roller independently associated with each respective sheet compartment wherein the conveyor roller of each sheet compartment is driven by the stepping motor of the other sheet compartment. The sheet drawn off from the stack is fed to a dispensing conveyor which is common to both sheet compartments. The drive for the system is carried out by the two stepping motors. The motors are operated in opposite directions when dispensing is taking place from each of the sheet compartments. While one motor is driving a delivery roller for its respective sheet compartment, the motor for the other sheet compartment drives the conveyor roller for the other sheet compartment. The delivery and conveyor rollers of one sheet compartment operate in one mode as the delivery and conveyor rollers of the other compartment idle. The delivery and conveyor rollers of the other compartment operate in a second mode as the delivery and conveyor rollers of the one compartment idle.

5 Claims, 3 Drawing Sheets

SYSTEM FOR DISPENSING SHEET MATERIAL, IN PARTICULAR SECURITY DOCUMENTS

BACKGROUND OF THE INVENTION

The invention relates generally to a system for dispensing sheet material, and particularly to a system for dispensing security documents, from one of two sheet compartments to a collecting station.

Such a system typically has a separate delivery roller assigned to each sheet compartment acting on the respective foremost sheet of a sheet stack in its respective compartment. Each delivery roller feeds the respective sheet drawn off from the stack to a respective conveyor roller assigned to each compartment. Each conveyor roller feeds the aforementioned sheet to a dispensing conveyor which is common to both sheet compartments. The delivery and conveyor rollers are driven by a stepping motor.

This system is used for the purpose of, for example, dispensing security documents, such as currency notes, of two different nominal values individually to the collecting station. To this end, security documents of one nominal value are in each case stacked in one sheet compartment, and always only one single currency note is drawn off from the respective stack and fed to the dispensing conveyor by the delivery and conveyor roller assigned to this sheet compartment. The dispensing system for different types of security documents therefore has a double module in which two individual modules for dispensing one type of security document in each case are connected via a common dispensing conveyor. A single module contains one sheet compartment and the delivery and conveyor roller assigned to the latter.

A system of this type is known from European Patent EP 0 161 742. In the case of the known system, there is a single stepping motor for driving the delivery rollers and the conveyor rollers of the two individual modules. By reversing the direction of rotation of the stepping motor, security documents are dispensed either from one or from the other individual module. The security documents are fed to a common dispensing conveyor via a shuttle conveyor assigned to each individual module. The shuttle conveyor systems are not suitable for a compact construction, because the systems utilize a significant proportion of the total structural space of an individual module and because additional components are necessary for their implementation.

A further disadvantage of the known system is that the individual modules and the shuttle conveyors are not identical and are thus not simply constructed. Hence, the individual modules or their component parts are also not interchangeable. The production outlay is thus higher than in the case of identical individual modules.

SUMMARY OF THE INVENTION

It is therefore an object of the invention to provide a system for dispensing sheet material which has a simple and compact construction.

This object is achieved, by utilizing two stepping motors which can be operated in opposite directions when dispensing from a sheet compartment. The two stepping motors drive one delivery roller in the first direction of rotation and the conveyor roller of the respective other sheet compartment in the second direction of rotation.

The use of two stepping motors enables integration of the respective shuttle conveyor into the associated conveyor roller of an individual module. This is because the delivery and conveyor roller can be driven in an optimum manner without restrictions arising as a result of the simultaneous driving of delivery and conveyor roller of an individual module. The delivery roller is rotated until the foremost security document has been drawn off, and the conveyor roller then rotates for such a time as is necessary for reliable conveying of the drawn off currency note to the central dispensing conveyor. As a result of this measure, separate shuttle conveyors can be dispensed with, which results in a more compact construction. As a result of the saving of components for the shuttle conveyors, a more simple construction in comparison with the prior art is achieved, and in addition the production outlay is reduced.

Each of the stepping motors drives in each case one delivery roller and the conveyor roller of the respective other sheet compartment. This allows one stepping motor to be allocated in each case to one sheet compartment, which produces identical individual modules. In this case, an individual module contains a sheet compartment, a delivery roller, a conveyor roller and a stepping motor.

Located in each module between the delivery roller and the stepping motor driving the delivery roller is a one-way clutch. Each one-way clutch enables a rotationally fixed connection of the driving stepping motor and delivery roller in one direction of rotation of the stepping motor, as well as the stopping of the delivery roller in the case of the opposite direction of rotation of the stepping motor. This measure is necessary since the two stepping motors are used for the independent driving of the delivery roller of one sheet compartment in one direction of rotation and the conveyor roller of the other sheet compartment in the other direction of rotation. To ensure that during a dispensing operation from an individual module, only the delivery roller assigned to that module rotates. Because of the one-way clutches, the delivery roller of the other sheet compartment does not rotate in any case when the conveyor roller, driven by the same stepping motor, of the sheet compartment from which dispensing is to take place, rotates. If the delivery roller of the other sheet compartment were to corotate, depending on the direction of rotation, separation would otherwise take place from two sheet compartments, or the delivery roller would push the security documents in the other sheet compartment against the wall of the sheet compartment as a result of the wrong direction of rotation. In order to avoid such a malfunction, the one-way clutches are used.

A further one-way clutch is located in each module between the conveyor roller and the stepping motor driving the conveyor roller. These additional one-way clutches prevent co-rotation of the transport roller during dispensing from an individual module and rotation of the delivery roller associated therewith. In contrast to the delivery rollers, although in this case no malfunction would occur since the corotating conveyor roller is not fed any security documents. Increased wear however is prevented by these additional one-way clutches. By means of the incorporation of the further system clutches, the wear as a result of abrasion on materials which are in contact with the conveyor rollers is limited to the extent absolutely necessary, since a conveyor roller rotates only for such a time as is necessary for the conveying of a security document. These materials are, in particular, rubber-covered rollers producing high friction characteristics, which are in contact with the conveyor rollers.

A preferred embodiment of the invention supplements the system according to the invention by means of two deflecting devices, in each case fitted in the direct vicinity of the conveyor rollers, for reversing the direction of the sheet material before it is fed to the dispensing conveyor. The deflecting devices enable the distance between two individual modules of a double module, and also the distance between the double modules, to have only half the diameter of a conveyor roller. This is because the security document is deflected through about 180° before it is fed to the central dispensing conveyor. As a result of the reduction of the distance between various modules, a compact construction is achieved. Since the deflecting devices in each individual module are in turn identical, this results in lower production costs in comparison to various individual modules, because of the simpler construction.

BRIEF DESCRIPTION OF THE DRAWINGS

An exemplary embodiment of the invention is explained below using the figures, in which.

DETAILED DESCRIPTION OF THE PREFERRED EMBODIMENTS

Figure 1:
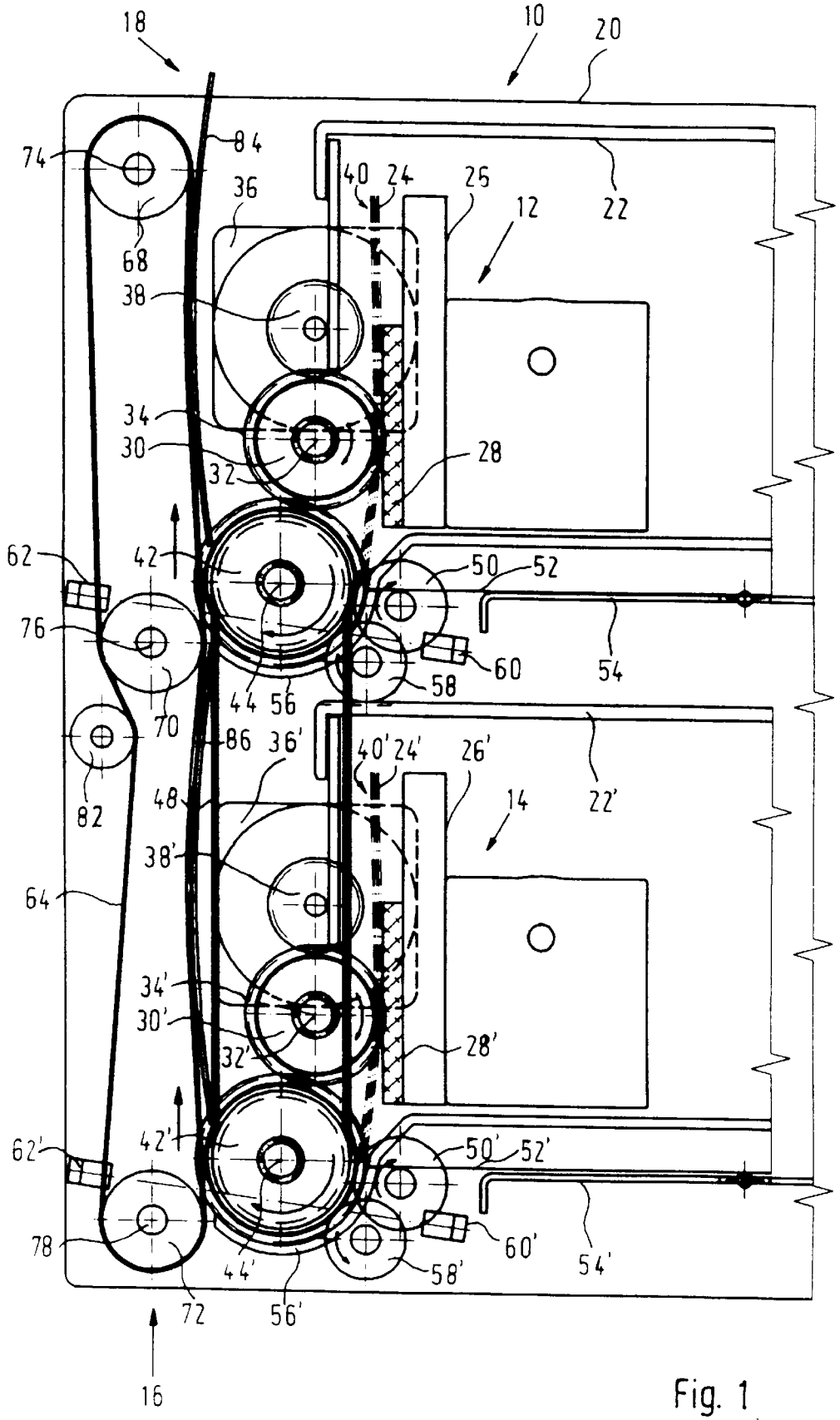
FIG. 1 shows the side view of a double module for dispensing sheet material from two sheet compartments along the section A—A in FIG. 2.
Figure 2:
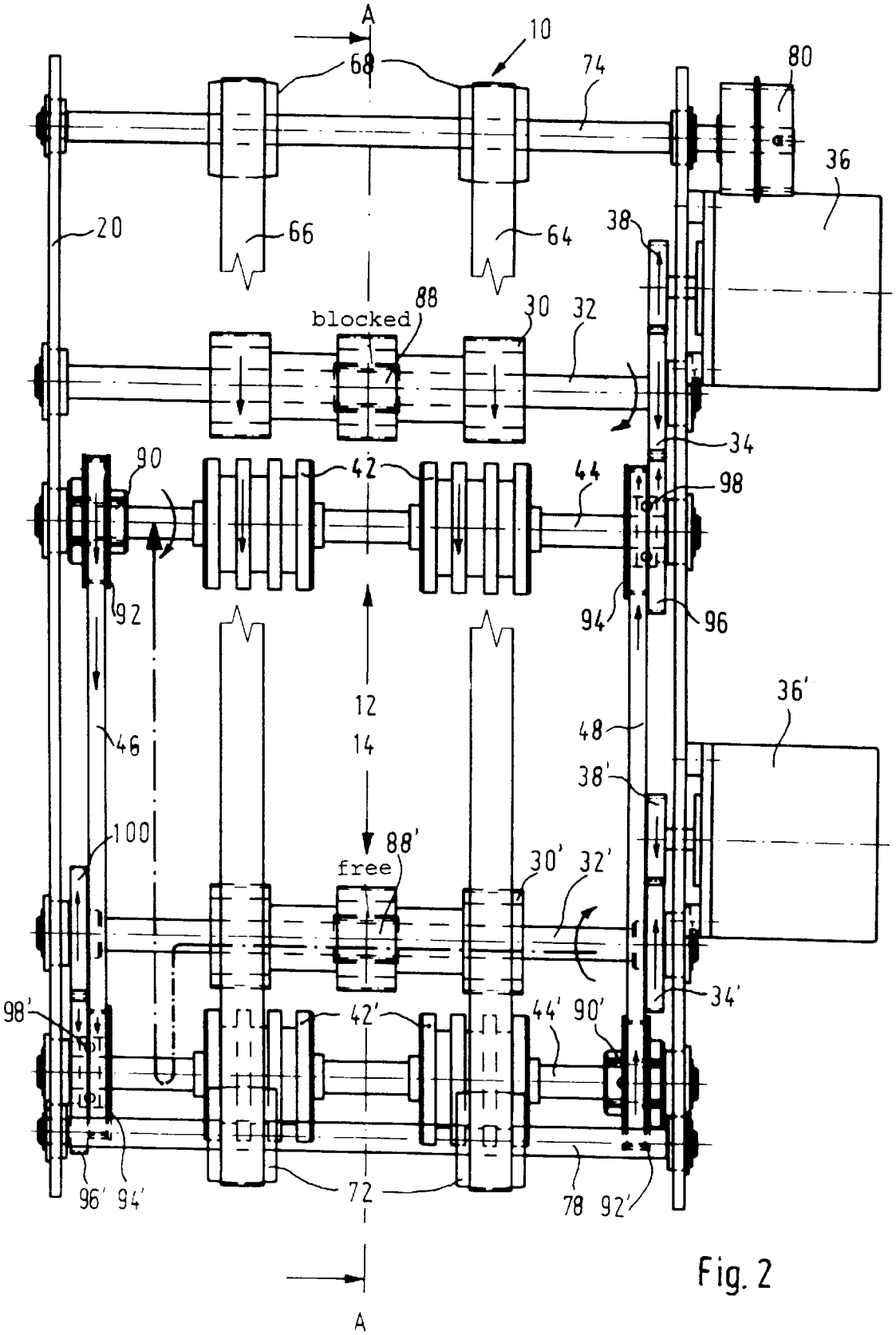
FIG. 2 shows the front view of the double module in a first mode of operation.
Figure 3:
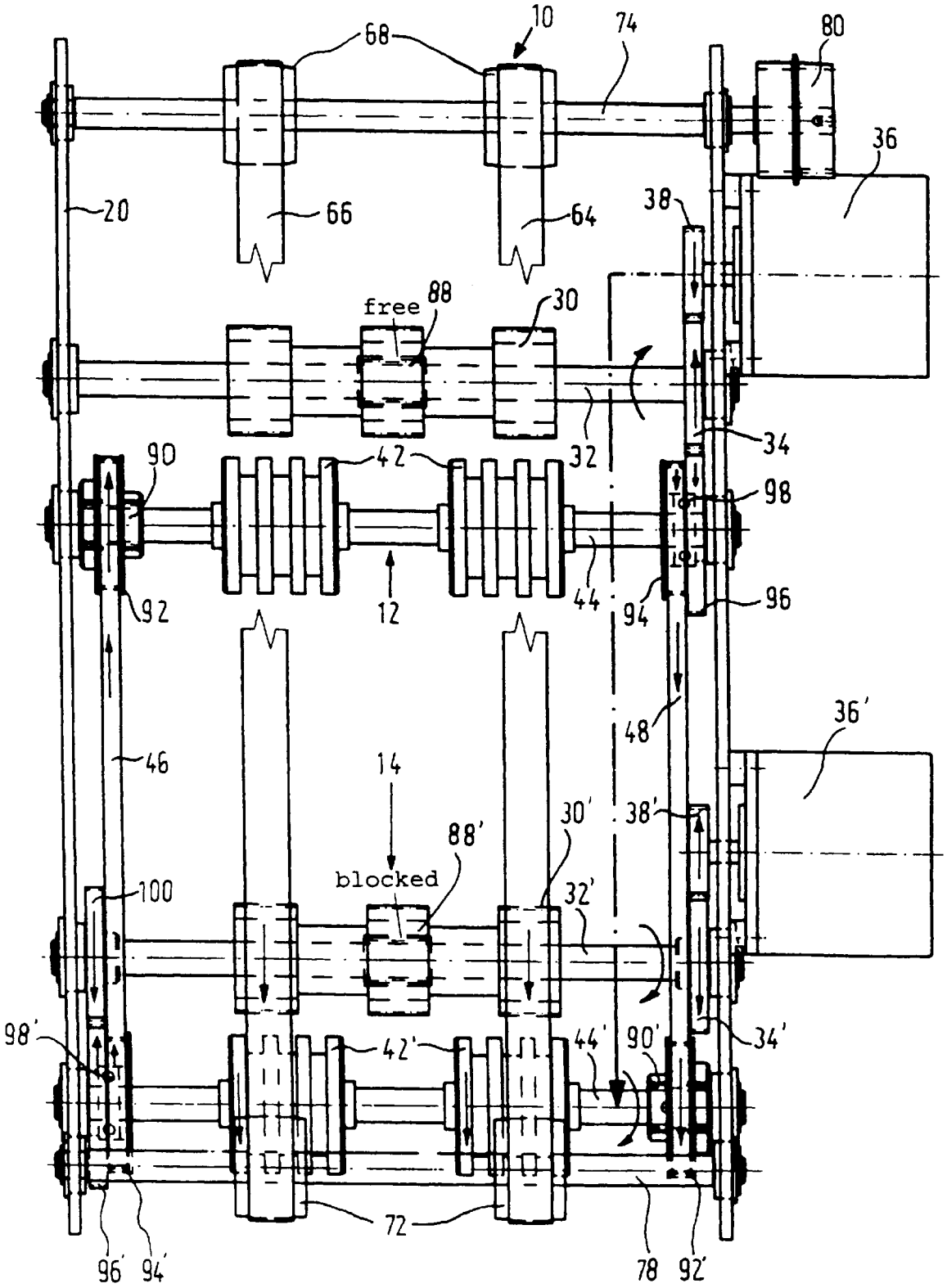
FIG. 3 shows the front view of the double module in a second mode of operation.

In FIGS. 1 to 3, arrows without reference symbols indicate the direction of rotation or the direction of movement of a specific component.

FIG. 1 shows the side view of a double module 10 for dispensing sheet material along the section A—A according to FIG. 2. The double module 10 comprises a first individual module 12 and a second individual module 14, which are connected by a common delivery conveyor 16. The sheet material, for example in the form of currency notes, is fed individually to a collecting station (not shown) via an outlet 18. The component parts of the double module 10 are carried by a frame 20. The two individual modules 12 and 14 are essentially identically constructed, so that only the first individual module 12 is described below, and the respective component parts of the second individual module 14 receive the same reference symbol, but with a superscripted stroke.

The currency notes are arranged in a sheet compartment 22 in the form of a horizontal sheet stack 24, and are pressed against a delivery roller 30 at an outlet of the sheet compartment 22 with the aid of a contact pressure slide 26, on the left-hand side of which there is a contact pressure rubber 28. The delivery roller 30 is fitted on a delivery shaft 32, at one end of which there is a delivery shaft gear wheel 34, which is driven by a stepping motor 36 via a pinion 38. The delivery roller 32 has a surface with a high coefficient of friction, so that the respectively foremost currency note 40 of the sheet stack 24 in the sheet compartment 22 is drawn off from the sheet stack 24 by rotating the delivery roller 30 when the stepping motor 36 is switched on, and is fed to a conveyor roller 42.

The conveyor roller 42 of the first individual module 12 is fitted on a conveyor shaft 44 and is driven via a first transmission by the stepping motor 36' of the second individual module 14. This makes it possible to drive the delivery roller 30 independently of the conveyor roller 42. The first transmission includes a belt 46 (shown in FIG. 2). The independent drive of delivery roller 30 and conveyor roller 42 is explained further below in conjunction with the first transmission, using FIGS. 2 and 3. Illustrated in FIG. 1 is a belt 48, which however belongs to a second transmission from the stepping motor 36 of the first individual module 12 to the second individual module 14.

The conveyor roller 42 is assigned a contrarotating roller 50, which is composed of a rubber-covered material with a high coefficient of friction, and prevents several currency notes being drawn off at the same time. To this end, the contrarotating roller 50 can be set rotating in a direction which is the same as the conveyor roller 42. Its drive is not shown in FIG. 1. In order to prevent the situation where, as a result of double or multiple deliveries, several currency notes are drawn off from the sheet stack 24, a holding comb 52 is also assigned to the individual module 14. The holding comb 52 is fastened to a holding element 54 and its end being fitted above the conveyor roller 42 in such a way that a maximum of one currency note can be conveyed by the conveyor roller 42.

When drawing off the foremost currency note 40 from the sheet stack 24 as the result of a rotation of the delivery roller 30, the delivery roller is rotated until the currency note 40 has been pushed between the conveyor roller 42 and the contrarotating roller 50. The conveyor roller 42 is then set into rotary motion and conveys the currency note 40 towards the common dispensing conveyor 16. In the process, a 180° deflection of the currency note 40 takes place with the aid of a guiding surface 56. In order to achieve reliable entrainment of the currency notes from the sheet stack 24 by the conveyor roller 42, a small conveyor roller 58 is fitted in the region of the start of the curvature of the guiding surface 56.

In the region of the guiding surface 56, a light barrier, comprising a transmitting element 60 for transmitting a light beam and a sensor 62 for receiving the light beam transmitted by the transmitting element 60, is assigned to the individual module 12. The signals from the sensor 62 can be used for the control of the stepping motors 36 and 36'. Thus, for example, the stepping motor 36 for driving the delivery roller 30 can be switched off when the currency note 40 interrupts the light beam from the transmitting element 60. The stopping of the conveyor roller 42 can be carried out when the end of the currency note 40 once more exposes the light beam of the transmitting element 60 in the direction of the sensor 62, after the currency note 40 has left the guiding surface 56.

When leaving the guiding surface 56, the currency note 40 is conveyed further by the conveyor roller 42 until it is gripped by the common dispensing conveyor 16.

The common dispensing conveyor 16 comprises two conveyor belts 64 and 66 (shown in FIG. 2). The conveyor belts 64 and 66 are guided by guide rollers 68, 70 and 72. The guide roller 68 is rotated by a drive (not shown) and thus drives the conveyor belts 64 and 66 which are carried on the rollers 68, 70 and 72 and rotated in the direction shown in FIG. 1. The guide rollers 68, 70 and 72 are in each case fastened on a guide shaft 74, 76 and 78, respectively. Located on the guide shaft 74 is a drive wheel 80 (shown in FIG. 2) for driving the guide shaft 74. The conveyor belts 64 and 66 are tensioned by a tension roller 82. The central dispensing conveyor 16 further includes contact pressure elements 84 and 86, each of which is assigned to the individual modules 12 and 14 and, as a result of their bowing, prevent the individual currency notes from losing contact with the conveyor belts 64 and 66 when being conveyed in the vertical direction.

FIG. 2 shows the front view of the double module 10 in a first mode of operation. In this mode dispensing takes place from the first individual module 12, since the stepping motors 36 and 36' are driven to rotate opposite one another in the directions of rotation illustrated. In the first individual module 12 there are two one-way clutches 88 and 90, which transmit a rotary movement only in one direction of rotation, and idle in the other direction of rotation. The one-way clutch 88 is located between the delivery roller 30 and delivery shaft 32. It is engaged or blocked when dispensing is taking place from the first individual module 12. Correspondingly, the delivery shaft 32, and with it the delivery roller 30, rotate in the manner illustrated by a direction-of-rotation arrow, driven by the stepping motor 36 via the pinion 38 and the delivery shaft gear wheel 34.

The one-way clutch 90 is located between the conveyor shaft 44 and a pulley 92, which is driven by the belt 46. The one-way clutch 90 transmits a rotary movement of the pulley 92 only in the first mode of operation illustrated in FIG. 2 to the conveyor shaft 44, which rotates in the direction which is once more specified by a direction-of-rotation arrow. The one-way clutch 90, the pulley 92 and the belt 46 are constituent parts of the first transmission, already mentioned, of the second individual module 14 for driving the conveyor shaft 44. In this case, the pulley 92 is the torque output drive. The torque input drive of the first transmission is not to be explained explicitly, since there is likewise an equivalent torque input drive on the conveyor shaft 44, but which is a constituent part of the second transmission from the first individual module 12 to the second individual module 14.

The second transmission includes the already mentioned belt 48, which is driven by a pulley 94. The pulley 94 is connected in a rotationally fixed manner to a conveyor belt gear wheel 96 and forms with the latter a unit 94, 96. The unit 94, 96 is mounted in an idling manner on the conveyor shaft 44 with the aid of a ball bearing 98, and is driven via the delivery shaft gear wheel 34, which engages with the conveyor shaft gear wheel 96. However, in the first mode of operation the second transmission transmits no torque to the second individual module 14 and is therefore only explained in FIG. 3 in terms of its function with reference to the mode of operation.

The dispensing operation in the first mode of operation is carried out, for example as a reaction to a request which has been processed by a known microprocessor control system. The microprocessor processes a stored control program and is intended during the processing to direct the system 10 to dispense a currency note 40 of a nominal value which is present in the sheet compartment 22 of the first individual module 12. To this end, the stepping motor 36 is driven in such a way that it rotates in a direction of rotation which is specified in FIG. 2 by an arrow on the pinion 38. After the abovementioned, since the freewheel of the one-way clutch 88 engages or blocks, the delivery roller 30 also begins to rotate. Because of friction between the delivery roller 30 and the currency note 40, the delivery roller 30 draws the note from the stack 24, until the start of the currency note 40 is pushed between conveyor roller 42 and contrarotating roller 50. The currency note 40 then interrupts the light beam from the transmitting element 60. The signal which is produced thereby at the sensor 62 causes the microprocessor control system to stop the rotation of the stepping motor 36 and hence the delivery operation and at the same time to rotate the conveyor roller 42 by means of appropriate driving of the stepping motor 36'. The torque flow from the stepping motor 36', which rotates in the opposite direction of the stepping motor 36, via the first transmission to the conveyor roller 42, is illustrated in FIG. 2 by the broken line. In this case, the torque input drive side of the first transmission, in contrast to the already explained second transmission, is not implemented via the corresponding delivery shaft gear wheel 34' at the end of the delivery shaft 32' nearest the stepping motor. The first transmission torque input is instead implemented via a second delivery shaft gear wheel 100 at the opposite end of the delivery shaft 32', whose direction of rotation is illustrated by a direction-of-rotation arrow.

The microprocessor control system drives the stepping motor 36', which rotates the conveyor roller 42, until the currency note 40, which is frictionally carried on the conveyor roller 42, is fed along the conveyor roller 42 to the dispensing conveyor 16 which is conveying at this time. The end of the currency note 40 once more exposes the light beam of the transmitting element 60 to the sensor 62. The dispensing conveyor 16 conveys the currency note 40 in the direction of the outlet 18 by means of frictional connection with the conveyor belts 64 and 66. At the said outlet 18, the currency note 40 can be fed directly to a collecting station, or to further double modules located upstream of the collection station in the conveying direction, or to the dispensing conveyors of the further double modules. When the dispensing operation has been completed, the microprocessor control system switches off the dispensing conveyor 16.

The one-way clutches 88' and 90' of the second individual module 14 are released in the first mode of operation illustrated in FIG. 2. Hence, the one-way clutch 88' does not transmit the movement of the delivery shaft 32' to the delivery roller 30'. In addition, the one-way clutch 90' does not transmit the rotary movement of the pulley 92' to the conveyor shaft 44'. The stepping motor 36' accordingly moves only the conveyor roller 42 of the first individual module 12 in the manner specified above.

FIG. 3 shows the front view of the double module 10 in the second mode of operation, in which dispensing takes place from the second individual module 14. The stepping motors 36 and 36', in comparison with the first mode of operation illustrated in FIG. 2, are driven such that they each rotate in the reverse direction of rotation. As a result, dispensing now takes place not from the first individual module 12 but from the second individual module 14.

The dispensing operation in the second mode takes place when the control program and the microprocessor direct the system 10 to dispense or output a currency note 40' having the nominal value of the currency note present in the individual module 14. The dispensing operation takes place in the same manner as specified above except as described below. For delivery, the stepping motor 36' is rotated with the aid of the delivery roller 30' and the stepping motor 36 is rotated for conveying the currency note 40' with the assistance of the conveying roller 42'. In the second mode of operation, the microprocessor control system controls the stepping motors 36 and 36' as a function of the signals from the sensor 60'. The torque flow from the stepping motor 36 via the second transmission to the conveyor roller 42' is illustrated in FIG. 3 by the broken line, the direction of rotation of the delivery shaft 32 being indicated by a direction-of-rotation arrow.

The one-way clutches 88 and 90 of the first individual module 12 are released in the second mode of operation. The one-way clutch 88' of the second individual module 14 is engaged or blocked, and transmits the rotation, indicated by a direction-of-rotation arrow, of the delivery shaft 32' to the delivery roller 30'. The one-way clutch 90' is likewise engaged or blocked and transmits the rotation of the pulley 92' to the conveyor shaft 44' and the conveyor roller 42', which is rigidly connected to the conveyor shaft, in accordance with the direction-of-rotation arrow on the conveyor shaft 44'.

Although various minor changes and modifications might be made by those skilled in the art, it will be understood that our wish is to include within the claims of the patent warranted hereon all such changes and modifications as reasonably come within our contribution to the art.

What is claimed is:

1. An apparatus for dispensing sheet material to a collecting station, the apparatus comprising:

a first sheet compartment adapted to house therein a first stack of the sheet material, the first sheet compartment having associated therewith a first delivery roller and a first conveyor roller;

a second sheet compartment adapted to house therein a second stack of the sheet material, the second sheet compartment having associated therewith a second delivery roller and a second conveyor roller;

a dispensing conveyor associated with both of the first and second sheet compartments;

a first stepping motor and a second stepping motor wherein the first stepping motor is operably coupled through gearing and a one-way clutch to the first delivery roller and through gearing and a one-way clutch to the second conveyor roller, the second stepping motor is coupled through gearing and a one-way clutch to the second delivery roller and through gearing and a one-way clutch to the first conveyor roller; and the first and second stepping motors being rotatable in opposite directions for operation in a first mode wherein the first delivery roller draws a foremost first sheet from the first stack and the first conveyor roller conveys the foremost first sheet to the dispensing conveyor, and in a second mode, wherein the second delivery roller draws a foremost second sheet from the second stack and the second conveyor conveys the foremost second sheet to the dispensing conveyor.

2. The apparatus according to claim 1, further comprising:

a first conveyor shaft carrying thereon the first conveyor roller;

a first delivery shaft carrying thereon the first delivery roller;

a second conveyor shaft carrying thereon the second conveyor roller;

a second delivery shaft carrying thereon the second delivery roller and wherein the first conveyor shaft is drivingly coupled to the second delivery shaft, and the second conveyor shaft is drivingly coupled to the first delivery shaft.

3. The apparatus according to claim 2, further comprising:

at least one drive belt coupling the first and second conveyor shafts to one another whereby when the at least one drive belt is rotated in one direction, the first conveyor shaft rotates the first conveyor roller and the second conveyor roller idles relative to the second conveyor shaft via the respective one-way clutch, and when the at least one drive belt is rotated in an opposite direction, the first conveyor roller idles relative to the first conveyor shaft via the respective one-way clutch and the second conveyor shaft rotates the second conveyor roller.

4. The apparatus according to claim 3, further comprising:

a gear mechanism rotatably coupling the first delivery shaft to the first conveyor shaft and a second gear mechanism rotatably coupling the second delivery shaft to the second conveyor shaft.

5. The apparatus according to claim 4, further comprising:

a pulley coupled to the at least one drive belt and affixed to a gear wheel which is rotatably driven by the first and second delivery shafts, the pulley or the gear wheel being freely rotatably mounted on the first and second conveyor shafts.

* * * * *